US005368716A

United States Patent [19]

Kikuta

[11] Patent Number: 5,368,716

[45] Date of Patent: Nov. 29, 1994

[54] METHOD AND APPARATUS FOR ANALYZING THE COMPOSITION OF AN ELECTRO-DEPOSITION COATING MATERIAL AND METHOD AND APPARATUS FOR CONTROLLING SAID COMPOSITION

[75] Inventor: Makoto Kikuta, Yokohama, Japan

[73] Assignee: Kansai Paint Co., Ltd., Hyogo, Japan

[21] Appl. No.: 963,219

[22] Filed: Oct. 19, 1992

[30] Foreign Application Priority Data

Oct. 21, 1991 [JP] Japan ..... 3-299578

[51] Int. Cl.[5] ..... C25D 21/14

[52] U.S. Cl. ..... 205/84; 204/434; 73/61.49; 73/61.75; 73/61.79; 73/64.53; 205/82; 205/101

[58] Field of Search ..... 205/81, 82, 84, 101; 73/61.49, 61.75, 61.79, 64.53; 204/434

*Primary Examiner*—John Niebling
*Assistant Examiner*—Edna Wong
*Attorney, Agent, or Firm*—Wenderoth, Lind & Ponack

[57] ABSTRACT

A real-time measurement is made of the proportions of solid matter and pigment contained in an electrodeposition coating material in an electrodeposition coating material tank. The attenuation of an ultrasonic wave through the electrodeposition coating material and the density and temperature of the electrodeposition coating material are measured, and a real-time measurement is made of the proportions of the solid matter and pigment by means of calculating these proportions on the basis of the measured ultrasonic-wave attenuation, density and temperature. Furthermore, the composition of the electrodeposition coating material is controlled on the basis of the results of said measurement.

10 Claims, 8 Drawing Sheets

METHOD AND APPARATUS FOR ANALYZING THE COMPOSITION OF AN ELECTRO-DEPOSITION COATING MATERIAL AND METHOD AND APPARATUS FOR CONTROLLING SAID COMPOSITION

FIELD OF THE INVENTION

The present invention relates to methods and apparatus for analyzing the proportions of solid matter and pigment contained in an electrodeposition coating material, and to methods and apparatus for controlling the composition of a coating material in an electrodeposition coating material tank.

BACKGROUND AND PRIOR ART OF THE INVENTION

Electrodeposition coating is a method of coating in which an electric current is applied to an electrically-conductive object dipped for coating in an electrodeposition coating material tank, to cause solid matter contained in an electrodeposition coating material to be deposited on the surface of the object to be coated, whereby a coat is formed. Thus, the solid matter contained in the electrodeposition coating material is taken away by the object to be coated and is apt to gradually lessen; therefore, in order to obtain the desired coating thickness, coating performance, etc., it is necessary to maintain the proportion of the solid matter contained in the electrodeposition coating material at a given value.

The following heating residues method has hitherto been used to measure solid matter contained in an electrodeposition coating material.

(1) The weight (A grams) of a weighing pan is measured.

(2) A sample of coating material is taken and put in the weighing pan, and the weight (B grams) of the weighing pan contains said sample is measured.

(3) The weighing pan containing the coating material is put in a dryer and heated at a temperature of, for example, 105° C. for 3 hours. After water, solvent and the like are evaporated, said weighing pan is gradually cooled in a desiccator. The weighing pan is taken out when cooled down to its normal temperature, and the weight (C grams) thereof is measured.

(4) The proportion of solid matter to the coating material is calculated by means of the formula (C-A)/(B-A).

Solid matter contained in an electrodeposition coating material consists of resin and pigment. As for the proportion of the pigment to the solid matter, the proportion of pigment to be taken away so as to be deposited on an object to be coated is different from the proportion of pigment contained in the electrodeposition coating material; therefore, the proportion of the pigment in the coating material is apt to gradually change during electrodeposition coating. And if the proportion of pigment contained in a coat is too high, the smoothness of the coat is lowered and the coat becomes brittle. On the other hand, if said proportion is too low, problems such as poor corrosion resistance (the coat becomes liable to rust), change in the color of the coat, etc., arise. Accordingly, in order to obtain the desired coating finish and coating performance, it is necessary to maintain the proportion of the pigment in the electrodeposition coating material at a given value.

The following ashing method has hitherto been used to measure the proportion of pigment contained in an electrodeposition coating material.

(1) The weight ("a" grams) of a crucible is measured.

(2) A sample of coating material is taken and put in the crucible, and the weight ("b" gram) of the crucible contained said sample is measured.

(3) The crucible containing the coating material is put in a dryer and dried at a temperature of, for example, 150° C. for 60 minutes so that water is evaporated. Then, said crucible is intensely heated (for about 30 to 60 minutes) by a gas burner so that organic matter is completely burned. After burning, the crucible is cooled in a desiccator, and the weight ("c" grams) thereof is measured.

(4) The proportion of pigment in the coating material is calculated by means of the formula (c-a)/(b-a).

However, a method of measuring solid content by using said heating residue method, and a method of measuring pigment contained in a coating material by using said ashing method, have the disadvantage that they require a great deal of expense, time and labor, since they comprise the steps of sampling, weighing, heating, gradual cooling, calculating, etc. Moreover, in those methods, no real-time measurement scan be made; therefore, they have the disadvantage that the proportions of solid matter and pigment are liable to change, etc.

As to methods for measuring the proportions of solid matter and pigment, Japanese Laid-Open Patent Publication Nos. 96296/88 and 26329/89 disclose a method of calculating the concentration of each of them on the basis of the attenuation of an ultrasonic wave through a coating material. In this method, real-time measurement is possible, and a high precision of measurement is obtained. But, at the time of measuring solid content, it is necessary that a change in ultrasonic-wave attenuation due to a change in the proportion of pigment be so small that it can be ignored. Also, at the time of measuring the proportion of pigment, it is necessary that the influence of a change in ultrasonic-wave attenuation due to a change in the proportion of solid content be minimal. Thus, this method has the disadvantage that the reliability of measured values is lowered in the case where the proportions of solid content and pigment content are simultaneously changed to a great extent. Furthermore, Japanese Laid-Open Patent Publication No. 70737/80 discloses a method of measuring the proportions of solid content on the basis of the attenuation of an ultrasonic wave through a suspension. However, this method also has the disadvantage that in the case where the proportions of solid content and pigment content are simultaneously changed to a great extent, the rate of change for each of them cannot be detected.

Thus, the problem which the present invention seeks to resolve is that it is not possible to make a real-time measurement of the proportions of solid matter and pigment contained in an electrodeposition coating material.

SUMMARY OF THE INVENTION

In the present invention, the attenuation of an ultrasonic wave through an electrodeposition coating material and the density and temperature of the electrodeposition coating material are measured. And, a real-time measurement is made of the proportions of solid matter and pigment contained in the electrodeposition coating material by means of calculating these proportions on the basis of the measured ultrasonic-wave attenuation, density and temperature.

For the purpose of resolving the aforementioned problem, the present invention provides a method for controlling the composition of an electrodeposition coating material in an electrodeposition coating material tank, which comprises the steps of:

measuring the attenuation L of an ultrasonic wave through the electrodeposition coating material and generating a signal regarding the attenuation of the ultrasonic wave;

measuring the density $\rho$ of the electrodeposition coating material and generating a signal regarding the density;

measuring the temperature T of the electrodeposition coating material and generating a signal regarding the temperature;

calculating the proportion N of solid matter and the proportion W of pigment contained in the electrodeposition coating material, on the basis of the signals regarding said ultrasonic-wave attenuation, density and temperature;

comparing the calculated proportions N and W of the solid matter and pigment contained in the electrodeposition coating material with reference values and generating control signals; and feeding supplementary coating material in accordance with said control signals.

For the purpose of resolving the aforementioned problem, the present invention also provides an apparatus for controlling the composition of an electrodeposition coating material in an electrodeposition coating material tank, which comprises:

an electrodeposition coating material tank for subjecting objects to be coated to electrodeposition coating;

an ultrasonic-wave attenuation measuring part which measures the attenuation L of an ultrasonic wave through the electrodeposition coating material and which generates a signal regarding the attenuation of the ultrasonic wave;

a density measuring part which measures the density $\rho$ of the electrodeposition coating material and which generates a signal regarding the density;

a temperature measuring part which measures the temperature T of the electrodeposition coating material and which generates a signal regarding the temperature;

an arithmetic operation circuit which calculates the proportion N of solid matter and the proportion W of pigment contained in the electrodeposition coating material, on the basis of the signals regarding said ultrasonic-wave attenuation, density and temperature;

an output circuit which compares the calculated proportions N and W of the solid matter and pigment contained in the electrodeposition coating material with reference values and which generates control signals; and a feed part for feeding supplementary coating material to said electrodeposition coating material tank, in accordance with said control signals.

For the purpose of resolving the aforementioned problem, the present invention further provides a method for analyzing the composition of an electrodeposition coating material in an electrodeposition coating material tank, which comprises the steps of:

measuring the attenuation L of an ultrasonic wave through the electrodeposition coating material and generating a signal regarding the attenuation of the ultrasonic wave;

measuring the density $\rho$ of the electrodeposition coating material and generating a signal regarding the density;

measuring the temperature T of the electrodeposition coating material and generating a signal regarding the temperature; and calculating the proportion N of solid matter and the proportion W of pigment contained in the electrodeposition coating material, on the basis of the signals regarding said ultrasonic-wave attenuation, density and temperature.

For the purpose of resolving the aforementioned problem, the present invention further provides an apparatus for analyzing the composition of an electrodeposition coating material in an electrodeposition coating material tank, which comprises:

an electrodeposition coating material tank for subjecting objects to be coated to electrodeposition coating;

an ultrasonic-wave attenuation measuring part which measures the attenuation L of an ultrasonic wave through the electrodeposition coating material and which generates a signal regarding the attenuation of the ultrasonic wave;

a density measuring part which measures the density $\rho$ of the electrodeposition coating material and which generates a signal regarding the density;

a temperature measuring part which measures the temperature T of the electrodeposition coating material and which generates a signal regarding the temperature; and an arithmetic operation circuit which calculates the proportion N of solid mater and the proportion W of pigment contained in the electrodeposition coating material, on the basis of the signals regarding said ultrasonic-wave attenuation, density and temperature.

DESCRIPTION OF THE EXAMPLE EMBODIMENT

The method and apparatus of the present invention will be explained by reference to FIGS. 1 to 14.

Figure 1:
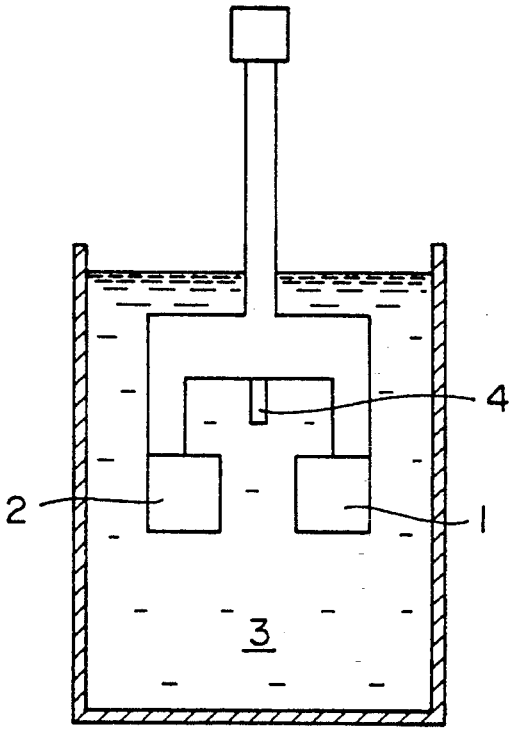
FIG. 1 is a drawing of an ultrasonic-wave attenuation measuring part.

As shown in FIG. 1, the attenuation of an ultrasonic wave is measured by means of dipping an ultrasonic-wave transmitter 1 and an ultrasonic-wave receiver 2 in a coating material 3 such that they are disposed with a given space there between, and on the basis of the strength of an ultrasonic wave generated at the transmitter 1 and the strength of the ultrasonic wave which has reached the receiver 2 after travelling in the liquid. Also, at the same time, the temperature of the liquid is measured by a temperature sensor 4.

Figure 2:
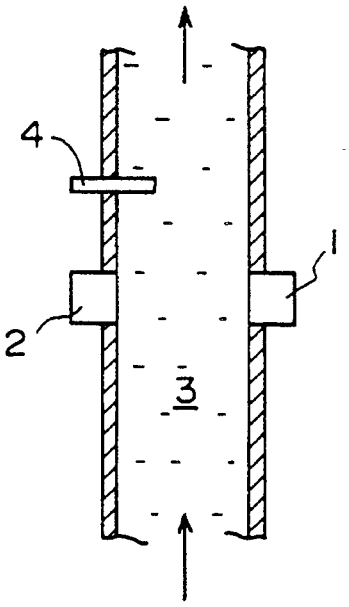
FIG. 2 is another drawing of the ultrasonic-wave attenuation measuring part.

Furthermore, as shown in FIG. 2, the ultra-sonic-wave transmitter 1 and the ultrasonic-wave receiver 2 may be disposed with a given space in between on a pipe in which the coating material 3 flows.

Figure 3:
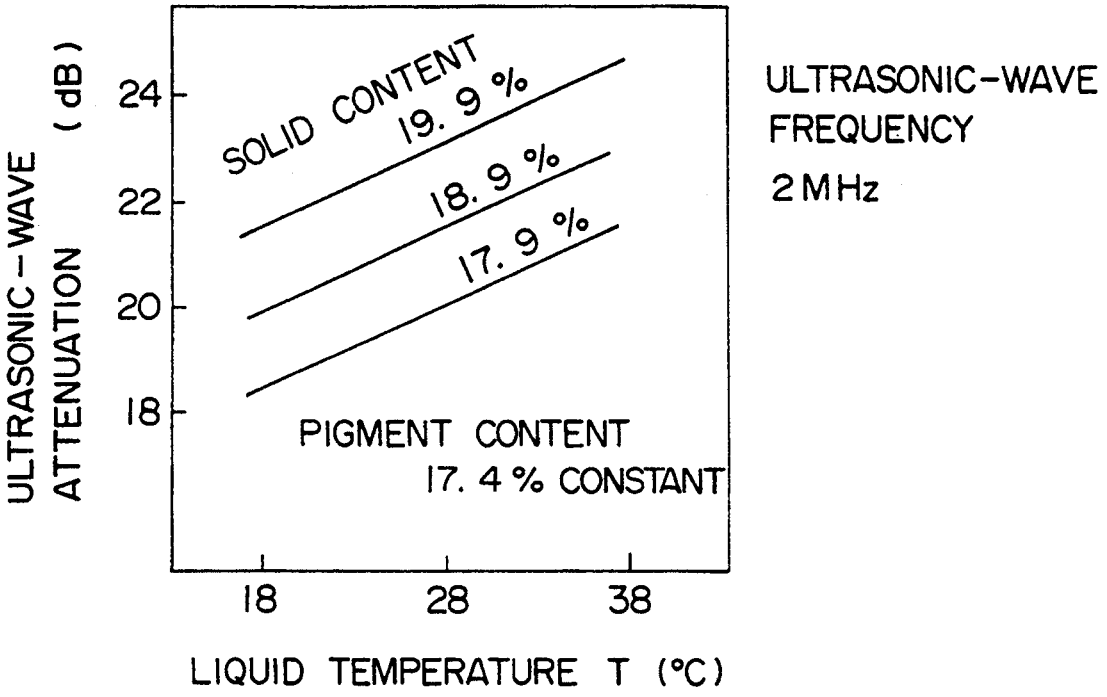
FIG. 3 is a diagram showing the relationship between the rate of ultrasonic-wave attenuation and liquid temperature affected by changes in the proportion of solid matter contained in an electrodeposition coating material.
Figure 4:
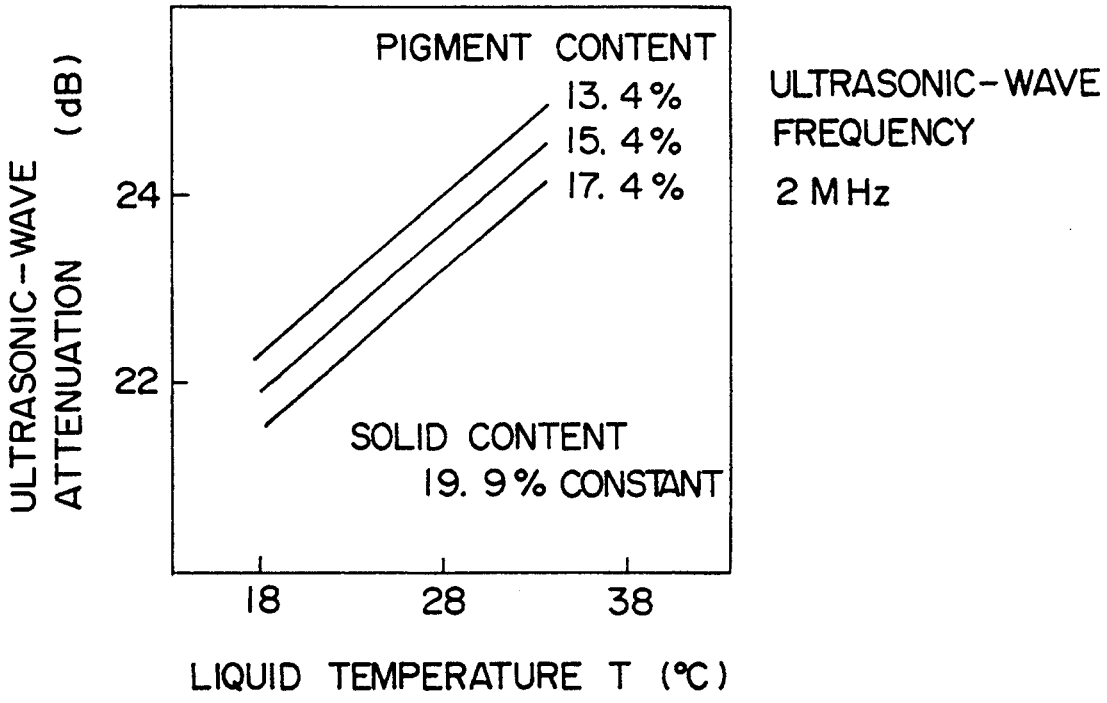
FIG. 4 is a diagram showing the relationship between the rate of ultrasonic-wave attenuation and liquid temperature affected by changes in the proportion of pigment contained in the electrodeposition coating material.

Some of the results of measurement are shown in FIGS. 3 and 4.

Figure 5:
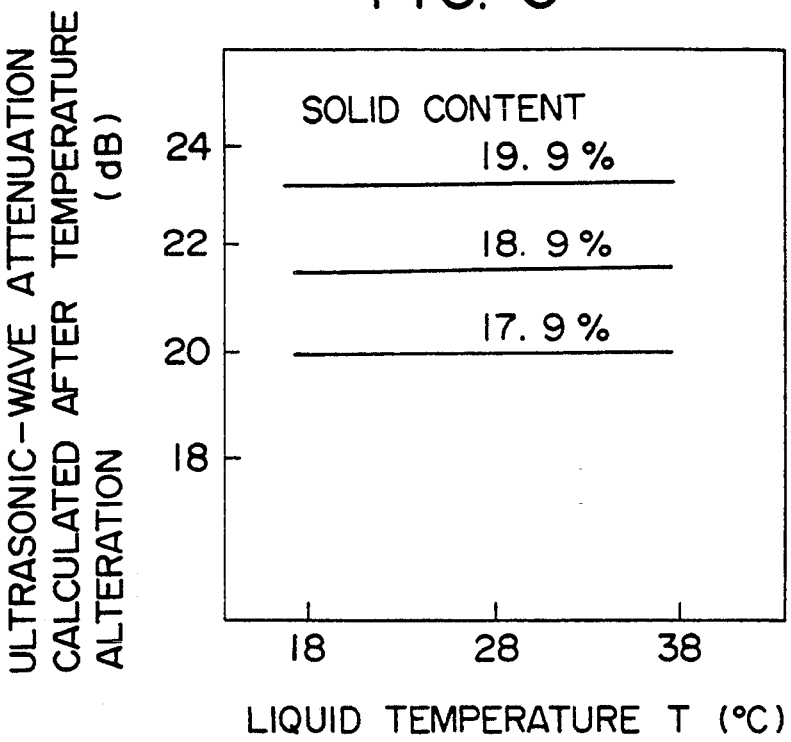
FIG. 5 is a diagram showing the relationship between the rate of ultrasonic-wave attenuation and liquid temperature in the electrodeposition coating material, which is obtained by making alterations to temperature.
Figure 6:
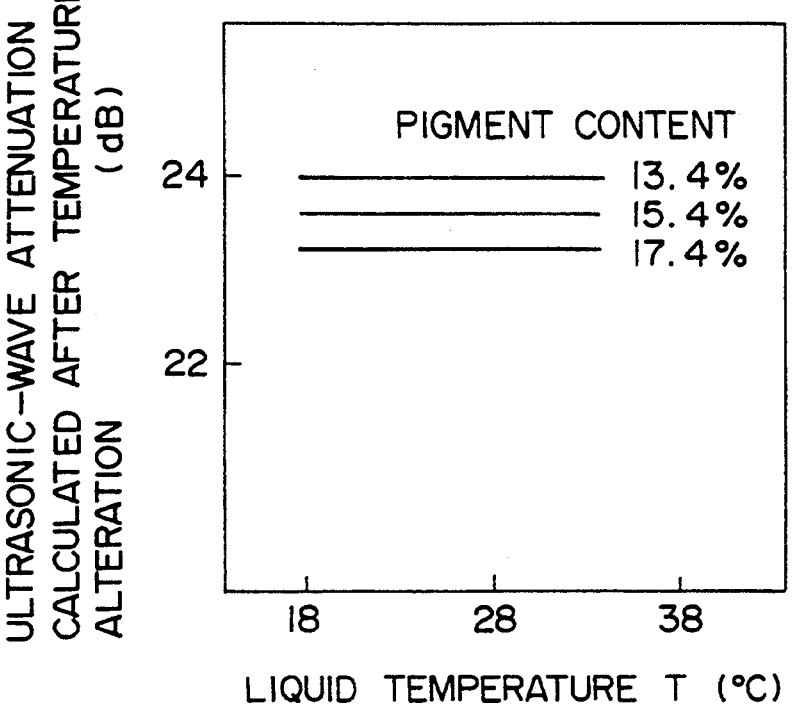
FIG. 6 is another diagram showing the relationship between the rate of ultrasonic-wave attenuation and liquid temperature in the electrodeposition coating material, which is obtained by making alterations to temperature.

FIG. 3 shows the relationship between ultra-sonic-wave attenuation and temperature, which is obtained when the proportion of solid matter to the coating material is changed while the proportion of pigment to the solid matter containing resin and pigment is kept constant. FIG. 4 shows the relationship between ultra-sonic-wave attenuation and temperature, which is obtained when the proportion of the pigment to the solid matter is changed while the proportion of the solid matter to the coating material is kept constant. It can be seen from FIGS. 3 and 4 that the attenuation of an ultrasonic wave is apt to change with a change in liquid temperature. If, however, an alteration is made to temperature on the basis of a liquid temperature of, for example, 28.0° C., as shown in the following formula (1), the attenuation of the ultrasonic wave becomes attenuation Ls which has nothing to do with liquid temperature, as shown in FIGS. 5 and 6.

$$Ls=L-0.17\cdot(T-28.0)\ldots\text{Formula} \quad (1)$$

Moreover, in case the relationship between liquid temperature and the rate of ultrasonic-wave attenuation in FIGS. 3 and 4 is not a linear relationship but is represented by curved lines, said attenuation can also be expressed by using a high-power expression such as a quadratic or cubic expression with respect to liquid temperature T.

The density of the coating material was calculated by using a method of calculating from the difference between the frequency of vibration obtained when a coating material is fed into a U-shaped or S-shaped pipe and the frequency of vibration obtained when a substance of known density is fed thereinto. This method is based on the fact that the frequency of vibration of the U-shaped or S-shaped pipe obtained varies depending on the density of the coating material with which the inside of the pipe is filled. Other methods for density measurement that can be used are a method of calculating from a change in the frequency of vibration of a vibratile thin-wall cylinder or pipe after dipping it in a liquid, a method of calculating from the buoyancy of a float after sinking it in a liquid, a method of calculating from the value of a liquid-level graduation on a float with graduations put heightwise thereon after sinking it in a coating material, etc.

Figure 7:
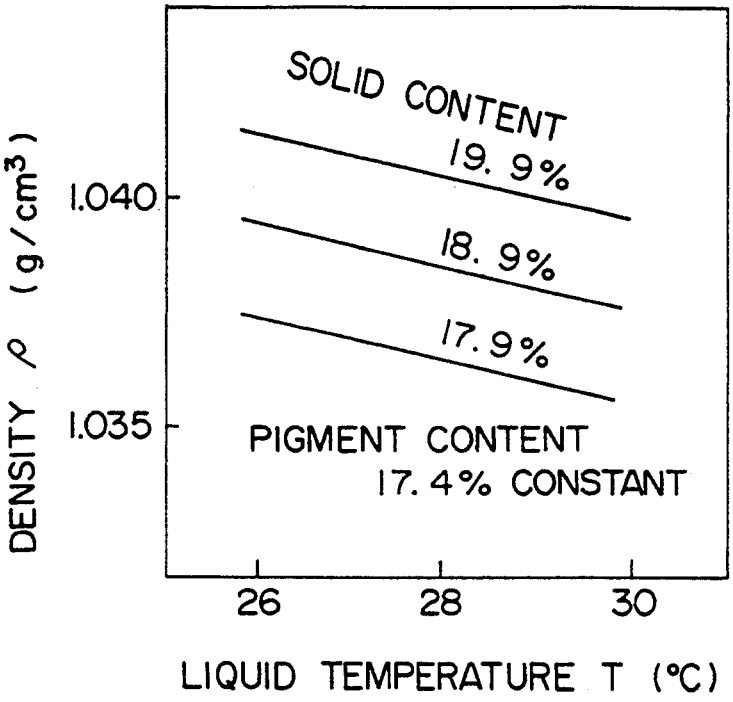
FIG. 7 is a diagram showing the relationship between density and liquid temperature affected by changes in the proportion of solid matter contained in the electrodeposition coating material.
Figure 8:
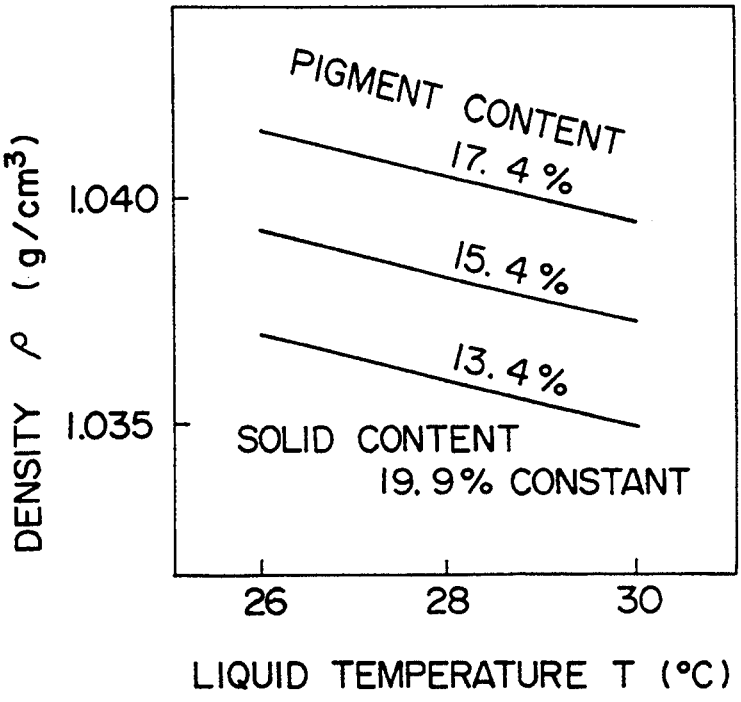
FIG. 8 is a diagram showing the relation between density and liquid temperature affected by changes in the proportion of pigment contained in the electrodeposition coating material.

Examples of measurement regarding the relationship between the density of the coating material and liquid temperature are shown in FIGS. 7 and 8.

Figure 9:
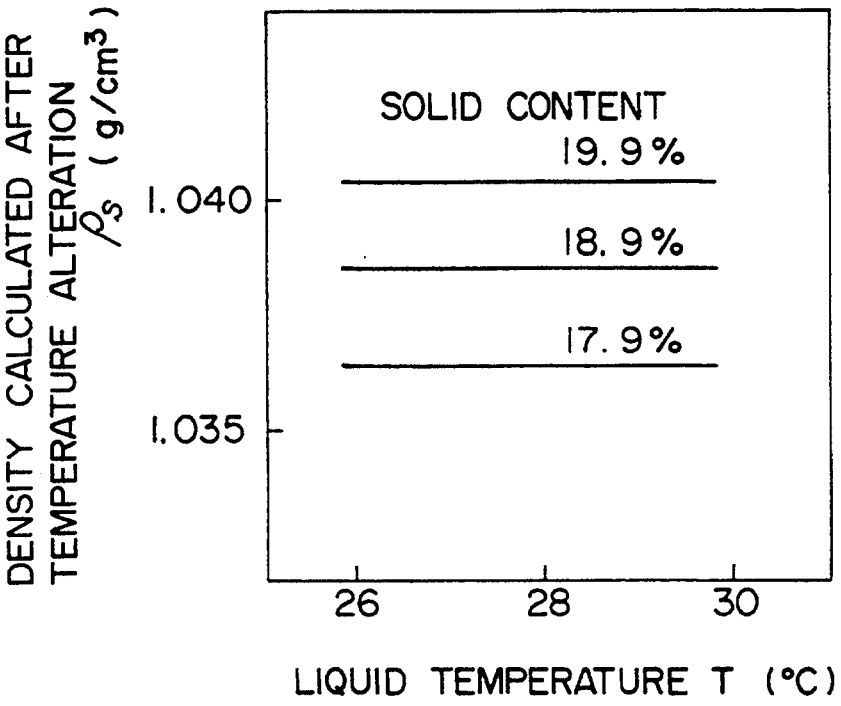
FIG. 9 is a diagram showing the relationship between density and liquid temperature in the electrodeposition coating material, which is obtained by making alterations to temperature.
Figure 10:
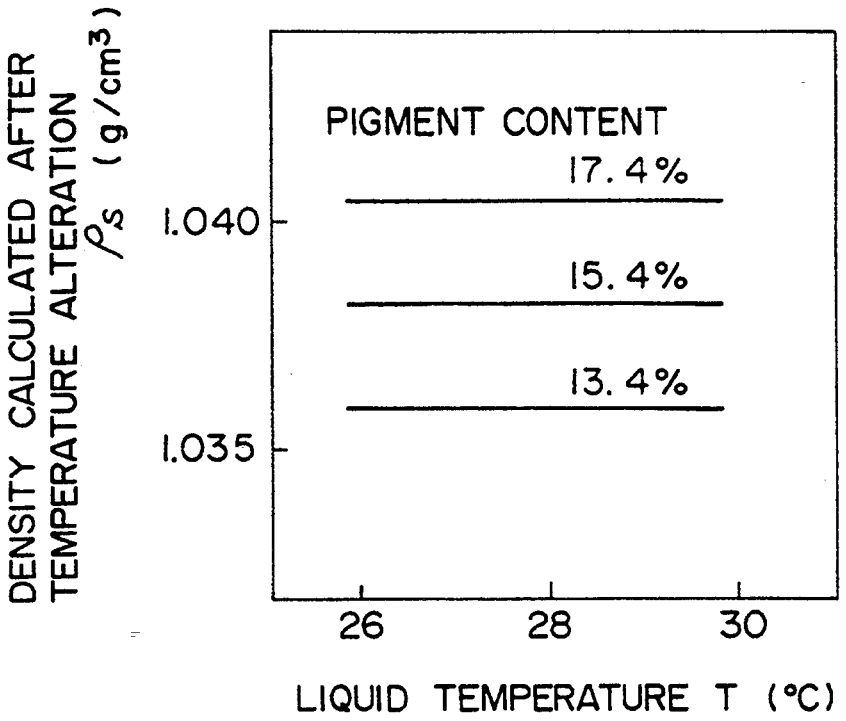
FIG. 10 is another diagram showing the relationship between density and liquid temperature in the electrodeposition coating material, which is obtained by making alterations to temperature.

FIG. 7 shows the relationship between the density of the coating material and liquid temperature, which is obtained when the proportion of solid matter to the coating material is changed while the proportion of pigment to the solid matter is kept constant. And, FIG. 8 shows the relationship between the density of the coating material and liquid temperature, which is obtained when the proportion of the pigment to the solid matter is changed while the proportion of the solid matter to the coating material is kept constant. It can be seen from FIGS. 7 and 8 that the density is apt to change with a change in liquid temperature. If, however, an alteration is made to temperature on the basis of a liquid temperature of, for example, 28.0° C., as shown in the following formula (2), the density becomes density $\rho s$ which has nothing to do with liquid temperature, as shown in FIGS. 9 and 10.

$$\rho s=\rho+0.00050\cdot(T-28.0)\ldots\text{Formula} \quad (2)$$

In this formula (2), the density is expressed with a linear expression regarding liquid temperature, but it is also possible to use a high-power expression such as a quadratic or cubic expression, similarly to the case of attenuation.

Figure 11:
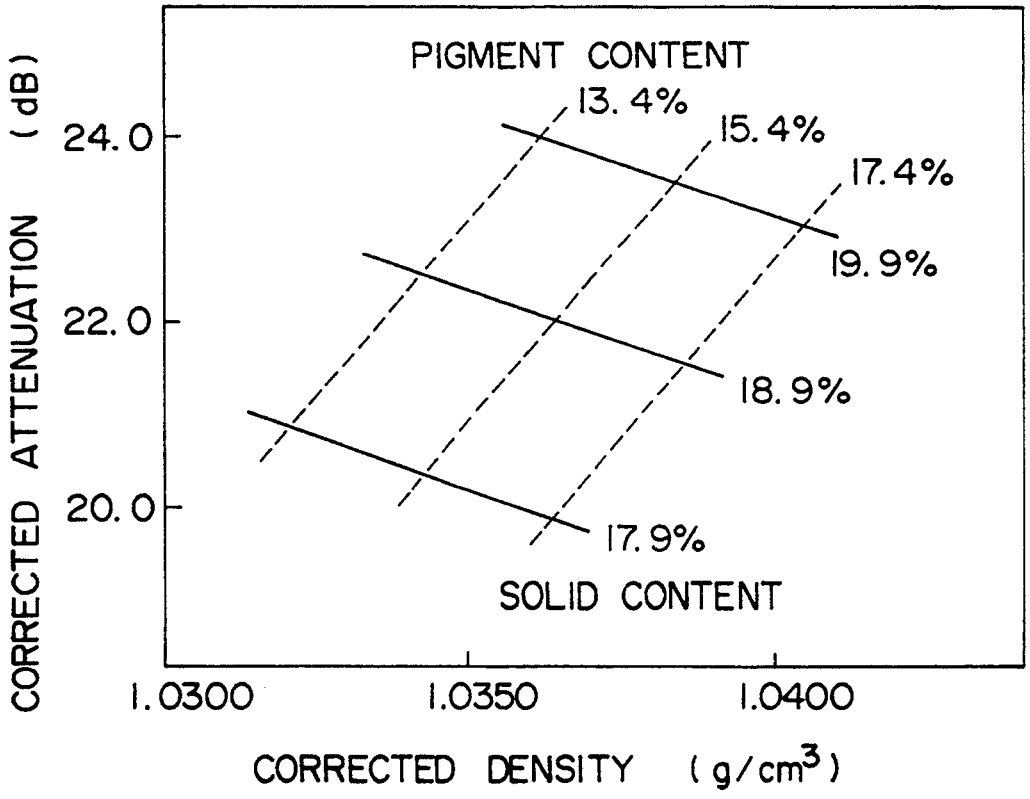
FIG. 11 is a diagram drawn by plotting there-on ultrasonic-wave attenuations and densities calculated after making alterations to temperature, with the proportions of solid content and pigment content as parameters.

FIG. 11 is a diagram drawn by plotting thereon attenuations Ls and densities $\rho s$ calculated after making the above alterations to temperature, with the proportions of solid content and pigment content as parameters. If attenuation Ls and density $\rho s$ are calculated after the above alterations are made to temperature, approximate values of the proportions of solid content and pigment content can be obtained from this diagram.

Furthermore, as shown in the following formula (3) and (4), if the proportion N of solid content and the proportion W of pigment are expressed with the polynomials of corrected attenuation Ls=f(V,T) and corrected density $\rho s = g(\rho, T)$, and if factors $A_1$–$A_9$ and $B_1$–$B_9$ are determined beforehand by using the method of least squares on the basis of the actually-measured values of attenuation L, density $\rho$ and liquid temperature T, it becomes possible, with respect to coating materials of the same kind, to calculate the proportion N of the solid content of a coating material and the proportion W of pigment, on the basis of the measured values of attenuation, density $\rho$ and liquid temperature T, by means of using formula (3) and formula (4), respectively.

$$N = F(\rho s, Ls) = A_1 + A_2\rho s + A_3 Ls + A_4\rho s^2 + A_5\rho s Ls + A_6 Ls^2 + A_7\rho s^2 \cdot Ls + A_8\rho s \cdot Ls^2 + A_9\rho s^2 \cdot Ls^2 \ldots \text{Formula} \quad (3)$$

$$W = G(\rho s, Ls) = B_1 + B_2\rho s + B_3 Ls + B_4\rho s^2 + B_5\rho s Ls + B_6 Ls^2 + B_7\rho s^2 \cdot Ls + B_8\rho s \cdot Ls^2 + B_9\rho s^2 \cdot Ls^2 \ldots \text{Formula} \quad (4)$$

Figure 12:
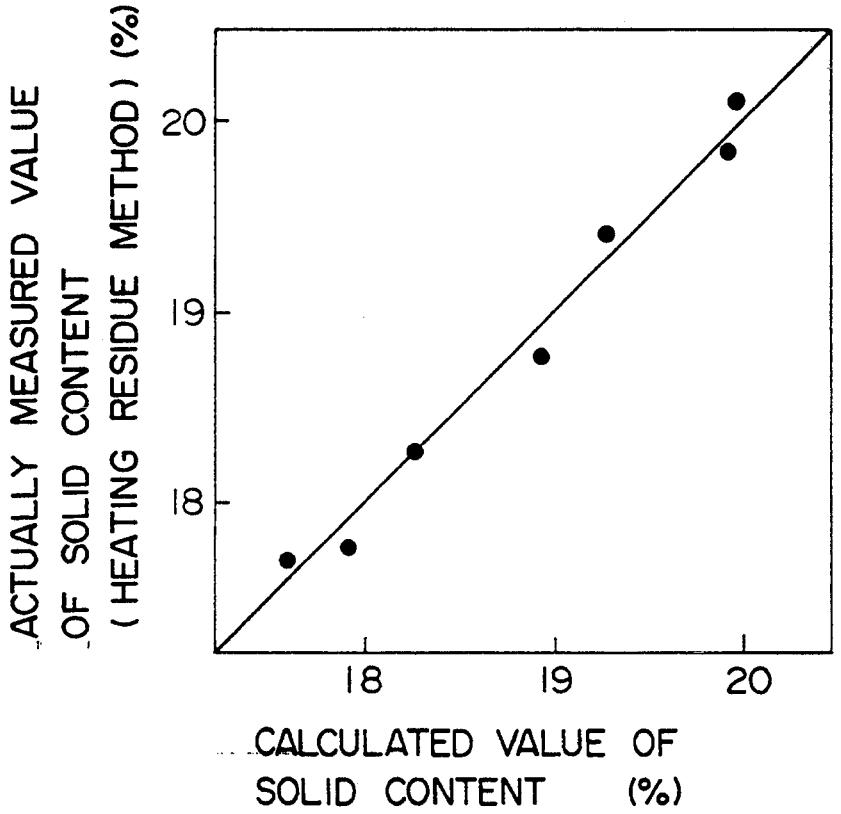
FIG. 12 is a diagram drawn by comparing the calculated values of solid content with the actually measured values thereof.
Figure 13:
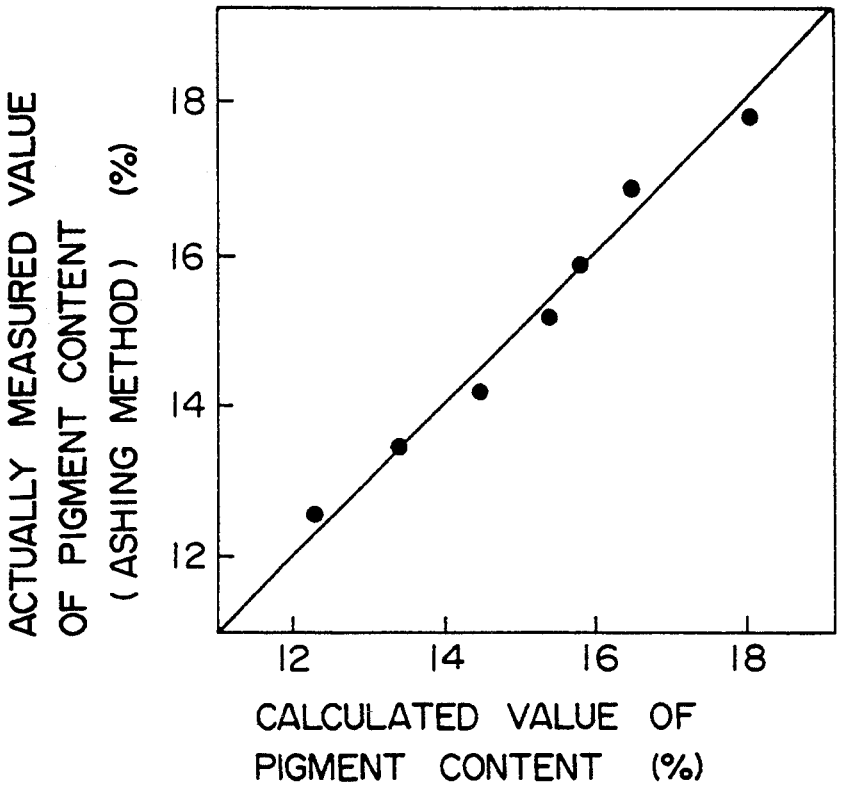
FIG. 13 is a diagram drawn by comparing the calculated values of pigment content with the actually measured values thereof.

FIG. 12 is a diagram drawn by comparing the calculated values of the proportion of solid content obtained by using formula (3) with the actually measured valves thereof obtained by using the heating residue method. FIG. 13 is a diagram drawn by comparing the calculated values of the proportion of pigment content obtained by using formula (4) with the actually measured values thereof obtained by using the ashing method. These values are almost equal to each other, and it can be seen that those methods are effective.

Figure 14:
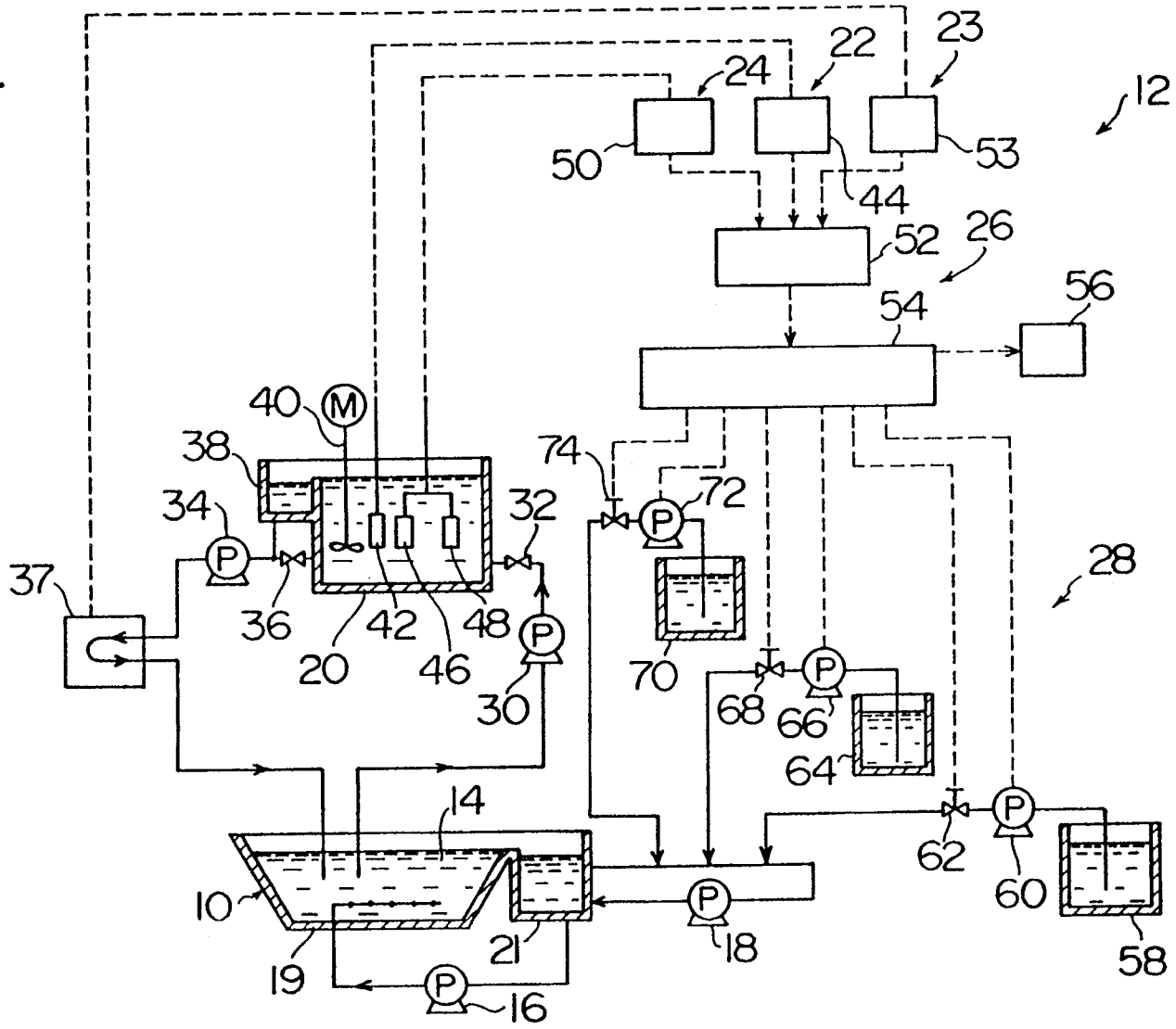
FIG. 14 is a schematic of an apparatus for controlling the composition of an electrodeposition coating material in accordance with an embodiment of the present invention.

The values of factors $A_1$–$A_9$ and $B_1$–$B_9$ determined by using the method of least squares on the basis of the actually-measured values of attenuation, density $\rho$ and liquid temperature T are as follows:

$A_1 = 0.0000$
$A_2 = 4.7032 \times 10^3$
$A_3 = 2.3195 \times 10^3$
$A_4 = -4.5266 \times 10^3$
$A_5 = -4.9001 \times 10^3$
$A_6 = -1.1193 \times 10^2$
$A_7 = 2.5687 \times 10^3$
$A_8 = 2.2540 \times 10^2$
$A_9 = -1.1326 \times 10^2$
$B_1 = 0.0000$
$B_2 = -2.3081 \times 10^4$
$B_3 = 6.1821 \times 10^3$
$B_4 = 2.2333 \times 10^4$
$B_5 = -9.9461 \times 10^3$
$B_6 = 2.4963 \times 10^2$
$B_7 = 3.8379 \times 10^3$
$B_8 = 4.3786 \times 10^2$
$B_9 = 1.9002 \times 10^2$ Next, a method of controlling the composition of a coating material by using a device for controlling solid matter and pigment for electrodeposition coating in accordance with the preferred embodiment of the present invention will be explained by reference to FIG. 14.

In FIG. 14 there are shown an electrodeposition coating material tank 10 for performing electrodeposition coating and a control device 12 for controlling the quantities of solid matter and pigment contained in a coating material in the electrodeposition coating material tank.

An electrodeposition coating material 14 in this electrodeposition coating material tank 10 is circulated by first and second circulating pumps 16 and 18 for the purpose of preventing sedimentation.

That is, the electrodeposition coating material tank 10 includes a main coating-material tank 19 and an auxiliary coating-material tank 21, and the coating material flows to the auxiliary coating-material tank 21 when it overflows the main coating-material tank 19. The first circulating pump 16 feeds the coating material from the auxiliary coating-material tank 21 toward the bottom of the main coating-material tank 19. Thus, the coating material flows and circulates through the auxiliary coating-material tank 21, the first circulating pump 16, a lower part of the main coating-material tank 19, an upper part of the main coating-material tank 19, and the auxiliary coating-material tank 21 again.

The second circulating pump 18, as shown in FIG. 14, forces the coating material out of the auxiliary coating-material tank 21 and returns it to the auxiliary coating-material tank 21. As explained below, in this embodiment, supplementary coating material and pure water are fed to the auxiliary coating-material tank 21 by this second circulating pump 18.

The control device 12 in the preferred embodiment of the present invention comprises a density measuring part 23, a measuring tank 20, a temperature measuring part 22, an ultrasonic-wave attenuation measuring part 24, an arithmetic operation part 26, and a feed part 28 for feeding supplementary coating material and pure water into the electrodeposition coating material tank 1.

The electrodeposition coating material is continuously fed to the measuring tank 20 from the electrodeposition coating material tank 10 through a valve 32 by an electrodeposition coating material feed pump 30. And the electrodeposition coating material is returned to the electrodeposition coating material tank 10 from the measuring tank 20 by a discharge pump 34 through a valve 36 and a frequency detector 37. The liquid level of the measuring tank 20 is kept constant by means of adjusting the degree of openness of the valves 32 and 36.

Moreover, as shown in FIG. 14, it is preferred to place an auxiliary tank 38 next to the measuring tank 20 so that an excess of electrodeposition coating material can be returned to the electrodeposition coating material tank 10 by the discharge pump 34.

In the measuring tank 20 there is disposed a stirrer 40, whereby the electrodeposition coating material is prevented from settling in the measuring tank 20.

The temperature measuring part 22 includes a temperature sensor 42 disposed in the electrodeposition coating material in the measuring tank 20, and a temperature measuring device 44 connected thereto. An electrical signal indicting an internal temperature of the electrodeposition coating material in the measuring tank 20 is output from the temperature measuring device 44.

The ultrasonic-wave attenuation measuring part 24 includes an ultrasonic-wave transmitter 46 and ultrasonic-wave receiver 48, which are disposed with a given space in between in the electrodeposition coating material of the measuring tank 20, as well as an ultrasonic-wave attenuation measuring device 50 connected to them. An electrical signal indicating the attenuation of an ultrasonic wave through the electrodeposition coating material in the measuring tank 20 is output from the ultrasonic-wave attenuation measuring device 50.

The density measuring part 23 includes the frequency detector 37 disposed in the pathway from the measuring tank 20 to the electrodeposition coating material tank 10, and a density measuring device 53 connected thereto. The density measuring device 53 converts an electrical signal indicating the frequency of vibration output from the frequency detector 37 into a signal equivalent to a density value, and outputs that signal.

The arithmetic operation part 26 includes an arithmetic operation circuit 52 for solid content and pigment content, an output circuit 54 and a recorder 56. This arithmetic operation part 26 is connected to the temperature measuring device 44, the ultrasonic-wave attenuation measuring device 50 and the density measuring device 53.

In the arithmetic operation circuit 52, corrected ultrasonic-wave attenuation Ls and corrected density $\rho s$ are calculated from correction formulae set in the circuit 52 after alterations are made to temperature, on the basis of the signals from the temperature measuring device 44 and ultrasonic-wave attenuation measuring device 50 and the signals from the temperature measuring device 414 and density measuring device 53, respectively.

In case the temperature of the coating material in the measuring tank 20 differs from that in the frequency detector 37, it is possible to dispose another temperature sensor in the frequency detector 37 and to make an alteration of the temperature for density calculation at the arithmetic operation circuit 52, by means of using a signal from this temperature sensor.

The proportion N of solid content is computed by using the calculated values of $\rho s$ and Ls for substitution in the function $N=F(\rho s,Ls)$ stored in the arithmetic circuit and expressed in density $\rho s$ and ultrasonic-wave attenuation Ls. Also, the proportion W of pigment contained in solid matter is computed by using the calculated values of $\rho s$ and Ls for substitution in the function $W=G(\rho s,Ls)$ stored in the arithmetic operation circuit and expressed in density $\rho s$ and ultrasonic-wave attenuation Ls.

A signal indicating the results of computation is transmitted from the arithmetic operation circuit 52 to the output circuit 54.

The recorder 56, as shown in FIG. 14, is connected to the output circuit 42, and it is preferred to record timewise changes in the proportions of solid content and pigment content.

Furthermore, the feed part 28, as explained below, is connected to the output circuit 52, and the feeding of supplementary coating material and pure water to the electrodeposition coating material tank 10 is controlled.

The feed part 28 includes a first supplementary coating material tank 58, a first supplementary coating material feed pump 60, a solenoid valve 62, a second supplementary coating material tank 64, a second supplementary coating material feed pump 66, a solenoid valve 68, a pure water tank 70, a pure water feed pump 72, and a solenoid valve 74.

As compared with the electrodeposition coating material in the electrodeposition coating material tank 10, both of the first supplementary coating material and the second supplementary coating material have a high proportion of solid content. Moreover, the proportion of pigment content to resin content is high in the first supplementary coating material, whereas said proportion is low or only resin constitutes solid matter in the second coating material.

The first supplementary coating material is sent from the tank 58 to a circulation channel including the circulating pump 18 through the pump 60 and solenoid valve 62, and is fed into the electrodeposition coating material tank. Likewise, the second supplementary coating material is fed into the electrodeposition coating material tank 10 from the tank 64 through the pump 66 and solenoid valve 68, and pure water is fed into the electrodeposition coating material tank 10 from the tank 70 through the pump 72 and solenoid valve 74.

This control device operates in the following manner on the basis of the values of the proportion N of solid content and proportion W of pigment as calculated in the arithmetic operation circuit 52.

If the proportion N of solid content and proportion W of pigment content are within the range of given reference values, the first supplementary coating material, the second supplementary coating material and pure water are fed in given quantities so as to simply make up for the loss of solid matter taken away from the electrodeposition coating material by an object to be coated.

In case it is found that the proportion N of the solid content of the electrodeposition coating material has become smaller than a lower-limit reference value $N_1$ of solid content as a result of comparison with the reference values at the output circuit 54, the speed of rotation of each of the motors of the first and second supplementary coating material feed pumps 60 and 66 is increased for additional feeding by a control signal from the output circuit 54; consequently, the proportion N of the solid content of the coating material in the coating material tank comes to increase. The proportion of solid content calculated by the arithmetic operation circuit 52 is continuously compared with an upper-limit reference value $N_3$ of solid content set in the output circuit 54, and if said proportion becomes greater than the upper-limit reference value $N_3$, the feed rates of the first supplementary coating material, second supplementary coating material and pure water are changed to their normal feed rates by control signals from the output circuit 54. Also, since solid matter contained in the coating material is deposited on the object to be coated and goes out of the system, the proportion of solid content is apt to decrease timewise, but if the proportion of solid content becomes greater than an upper-limit reference value $N_4$ for some reason, the speed of rotation of a motor of the pure water feed pump 72 is increased by a control signal from the output circuit 54 so that pure water is fed more than its normal quantity to be fed. As a result, the proportion of solid matter in the coating material tank comes to decrease. And the proportion of solid content continuously calculated is compared with a lower-limit value $N_2$ of solid content. If said proportion becomes smaller than the lower-limit value $N_2$, the feed rate of pure water is changed to its normal feed rate by a signal from the output circuit 54.

The proportion of pigment in the electrodeposition coating material calculated at the arithmetic operation circuit 52 is compared with set values at the output circuit 54. In case said proportion is smaller than a lower-limit reference value $W_1$ of pigment content, the speed of rotation of the motor of the first supplementary coating material feed pump 60 is increased by a control signal from the output circuit 54 so that the feed rate of the first supplementary coating material having a high proportion of pigment is increased, and the speed of rotation of the motor of the second supplementary coating material feed pump 66 is decreased so that the feed rate of the second supplementary coating material having a low proportion of pigment is decreased. And further, the speed of rotation of the motor of the pure water feed pump is changed so that the feed rate of pure water is changed to keep constant the proportion of solid matter to the whole of the liquid provided.

The coating material in the electrodeposition coating material tank 10 is always circulated through the electrodeposition coating material feed pump 30, measuring tank 20, frequency detector 37 and discharge pump 34, and the proportion of pigment content is continuously measured.

In case it is found that the proportion W of pigment content has become greater than an upper-limit reference value $W_3$ of pigment content as a result of comparison with the reference values at the output circuit 54, the feed rates of the first supplementary coating material, second supplementary coating material and pure water are changed to their normal feed rates by control signals from the output circuit 54.

Moreover, in case said proportion is greater than an upper-limit reference value $W_4$ of pigment content, the speed of rotation of the motor of the second supplementary coating material feed pump 66 is increased so that the coating material having a low proportion of pigment is fed into the electrodeposition coating material tank 10, and the feed rate of pure water is changed so that the proportion of solid matter to the whole of the liquid provided is kept constant. After that, the proportion W of pigment content continues to be compared with the preference values at the output circuit 54, and if said proportion becomes smaller than a lower-limit reference value $W_2$ of pigment content, the feed rates of the first supplementary coating material, second supplementary coating material and pure water are changed to their normal feed rates by control signals from the output circuit 54.

In the above embodiment, the temperature sensor 42, ultrasonic-wave transmitter 46 and ultrasonic-wave receiver 48 are disposed in the measuring tank 20 provided separately from the electrodeposition coating material tank 10. However, for example, these can be disposed in the electrodeposition coating material tank 10, or in a channel including the first circulating pump 16.

Furthermore, in the electrodeposition coating material tank 10 there is disposed a liquid level sensor (not shown). In case the liquid level of the tank is lower than a set value, it is possible to receive a signal indicating this at the output circuit 54 and to feed the first supplementary coating material, the second supplementary coating material and pure water in given quantities, even if solid content and pigment content are within the range of given values. Also, if the liquid level is higher than a reference value, it is possible to stop feeding said supplementary coating materials and pure water until the liquid level is reduced to the level of the reference value after solid matter in the coating material in the tank is taken away from the system, even if solid content and pigment content are outside the range of the given values.

According to the present invention, the proportions of solid matter and pigment contained in an electrodeposition coating material can be measured automatically and quickly, and consequently, the proportions of solid matter and pigment contained in a coating material in an electrodeposition coating material tank can be efficiently controlled.

What is claimed is:

1. An apparatus for analyzing the composition of an electrodeposition coating material in an electrodeposition coating material tank comprising:

an electrodeposition coating material tank for subjecting objects to be coated to electrodeposition coating;

an ultrasonic-wave attenuation measuring part which measures the attenuation L of an ultrasonic wave through the electrodeposition coating material and which generates a signal indicative of the attenuation of the ultrasonic wave;

a density measuring part which measures the density $\rho$ of the electrodeposition coating material and which generates a signal indicative of the density;

a temperature measuring part which measures the temperature T of the electrodeposition coating material and which generates a signal indicative of the temperature; and an arithmetic operation circuit which calculates the proportion N of solid matter and the proportion W of pigment contained in the electrodeposition coating material, on the basis of the signals indicative of said ultrasonic-wave attenuation, density and temperature.

2. The apparatus according to claim 1 wherein the ultrasonic-wave attenuation measuring part is deposed in the electrodeposition coating material tank.

3. The apparatus according to claim 1 wherein the ultrasonic-wave attenuation measuring part is disposed in a measuring tank and wherein a coating material in the measuring tank and the coating material in the electrodeposition coating material tank are circulated.

4. A method for controlling the composition of an electrodeposition coating material in an electrodeposition coating material tank comprising the steps of:

measuring the attenuation L of an ultrasonic wave through the electrodeposition coating material and generating a signal indicative of the attenuation of the ultrasonic wave;

measuring the density $\rho$ of the electrodeposition coating material and generating a signal indicative of the density;

measuring the temperature T of the electrodeposition coating material and generating a signal indicative of the temperature;

calculating the proportion N of solid matter and the proportion W of pigment contained in the electrodeposition coating material, on the basis of the signals indicative of said ultrasonic-wave attenuation, density and temperature;

comparing the calculated proportions N and W of the solid matter and pigment contained in the electrodeposition coating material with reference values and generating corresponding control signals; and feeding supplementary coating material in accordance with said control signals.

5. The method according to claim 4, further comprising selectively feeding into the electrodeposition coating material tank any of a first supplementary coating material having higher proportions of solid content and pigment content than that of a reference coating material, a second supplementary coating material having a higher proportion of solid content and a lower proportion of pigment content than that of the reference material, and pure water

6. An apparatus for controlling the composition of an electrodeposition coating material in an electrodeposition coating material tank comprising:

an electrodeposition coating material tank for subjecting objects to be coated to electrodeposition coating;

an ultrasonic-wave attenuation measuring part which measures the attenuation L of an ultrasonic wave through the electrodeposition coating material and which generates a signal indicative of the attenuation of the ultrasonic wave;

a density measuring part which measures the density $\rho$ of the electrodeposition coating material and which generates a signal indicative of the density;

a temperature measuring part which measures the temperature T of the electrodeposition coating material and which generates a signal indicative of the temperature;

an arithmetic operation circuit which calculates the proportion N of solid matter and the proportion W of pigment contained in the electrodeposition coating material, on the basis of the signals indicative of said ultrasonic-wave attenuation, density and temperature;

an output circuit which compares the calculated proportions N and W of the solid matter and pigment contained in the electrodeposition coating material with reference values and which generates corresponding control signals; and a feed part for feeding supplementary coating material to said electrodeposition coating material tank, in accordance with said control signals.

7. The apparatus according to claim 6 wherein the feed part is provided with means for feeding, in accordance with a first control signal, a first supplementary coating material having higher proportions of solid content and pigment content than that of a reference coating material, means for feeding, in accordance with a second control signal, a second supplementary coating material having a higher proportion of said solid content and a lower proportion of pigment content than that of the reference material, and means for feeding pure water in accordance with a third control signal.

8. A method for analyzing the composition of an electrodeposition coating material in an electrodeposition coating material tank, comprising:

transmitting an ultrasonic wave through the electrodeposition coating material;

detecting the ultrasonic wave transmitted through the electrodeposition coating material, determining an attenuation of the ultrasonic wave transmitted through the electrodeposition coating material, and generating a first signal indicative of the attenuation of the ultrasonic wave transmitted through the electrodeposition coating material;

measuring a density of the electrodeposition coating material and generating a second signal indicative of the density of the electrodeposition coating material;

sensing a temperature of the electrodeposition coating material and generating a third signal indicative of the temperature of the electrodeposition coating material; and, processing said first through third signals to determine a proportion of solid matter and a proportion of pigment contained in the electrodeposition coating material on the basis of said attenuation, said density and said temperature.

9. A method according to claim 8, wherein the ultrasonic wave is transmitted and detected within the electrodeposition coating material tank.

10. A method according to claim 9, wherein the ultrasonic wave is transmitted and detected in a measuring tank, and wherein said method further comprises circulating the electrodeposition coating material between the measuring tank and the electrodeposition coating material tank.

* * * * *